US007294236B2

(12) United States Patent
Halme et al.

(10) Patent No.: US 7,294,236 B2
(45) Date of Patent: Nov. 13, 2007

(54) ARRANGEMENT FOR CONTROLLING THE WEB IN A PRESS SECTION OF A PAPER OR BOARD MACHINE

(75) Inventors: Petteri Halme, Jyväskylä (FI); Tatu Halonen, Jyväskylä (FI); Jorma Laapotti, Palokka (FI); Riku Pihko, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 496 days.

(21) Appl. No.: 10/863,853

(22) Filed: Jun. 8, 2004

(65) Prior Publication Data

US 2005/0000670 A1 Jan. 6, 2005

(51) Int. Cl.
*D21F 3/04* (2006.01)
*D21F 1/48* (2006.01)

(52) U.S. Cl. ..... 162/358.1; 162/363; 162/374

(58) Field of Classification Search ..... 162/193, 162/204, 205, 306, 358.1, 358.3, 359.1, 360.2, 162/360.3, 363, 366, 374, 305
See application file for complete search history.

(56) References Cited

U.S. PATENT DOCUMENTS 4,081,320 A * 3/1978 Wahren et al. ..... 162/205
4,191,612 A 3/1980 Araoka
5,328,569 A * 7/1994 Cronin ..... 162/306
5,972,170 A * 10/1999 Hund et al. ..... 162/358.1
5,989,393 A * 11/1999 Kivimaa et al. ..... 162/360.2
6,375,800 B1 * 4/2002 Steiner et al. ..... 162/193
6,666,954 B2 * 12/2003 Kotitschke et al. ..... 162/205
6,730,192 B1 * 5/2004 Laapotti ..... 162/205
6,863,776 B2 * 3/2005 Begemann et al. ..... 162/205

FOREIGN PATENT DOCUMENTS

EP 0559629 9/1993
EP 1 101 864 5/2001

* cited by examiner

*Primary Examiner*—Eric Hug
(74) *Attorney, Agent, or Firm*—Fildes & Outland, P.C.

(57) ABSTRACT

An arrangement is disclosed for controlling the web in a press section of a paper of board machine wherein the press section includes a press nip and two fabrics arranged to travel through it. In addition, the press section includes a suction roll with a suction apparatus fitted after the press nip. The suction apparatus includes at least one suction case, which is arranged in a closing throat and/or an opening throat formed by one of the fabrics and the suction roll. The suction case is also arranged before and/or after the suction roll in the edge of the fabric in order to create a suction effect in a narrow edge area of the web.

12 Claims, 6 Drawing Sheets

ARRANGEMENT FOR CONTROLLING THE WEB IN A PRESS SECTION OF A PAPER OR BOARD MACHINE

FIELD OF THE INVENTION

The present invention relates to an arrangement for controlling the web in a press section of a paper of board machine, which press section includes

- at least one press nip, which is formed of two press rolls set opposite to each other,
- two fabrics arranged to travel through the press nip, which are arranged to transport the web being manufactured on the paper or board machine,
- a suction roll arranged after the press nip, for transferring the web to the desired fabric, when the web is travelling being between the fabrics between the press nip and the suction roll, and
- suction apparatus in connection with the suction roll, in which there is a cover equipped with suction openings, and which is arranged in connection with the fabrics.

BACKGROUND OF THE INVENTION

In the press section of a web-formation machine, such as a paper or board machine, a great deal of water is removed from the web. The water is removed using a press nip formed from two rolls. Usually the web is led to the press nip between two fabrics. After the press nip, the web is guided onwards in the web-forming machine, supported by a fabric.

Before the press section or the press nip, the edges of the web are evened, usually by water cutting. In addition, the edge parts of the fabric become dirty more rapidly than the rest of the fabric. The previous processing of the web also make the edges different to the rest of the web while the edge parts also stretch. Thus, the edges of the web tend to adhere to the first fabric, even though the rest of the web is guided to another fabric after the press nip using the vacuum effect of a suction roll. Usually the edges of the web detach from the fabric after a delay, which further stretches the edges and causes flutter in the web. The flutter is also increased by the low tension in the web and the airflow caused by the fabrics. In addition, centrifugal force in the area of the suction roll further increases the stretching of the edges. The stretched and even creased edges of the web must be cut off later, which reduces production efficiency. In the worst case, the irregular edges of the web may even cause the web to break during transfer, or during processing in the paper or board machine. The irregular and stretched edges are a major problem particularly when coating the web.

Attempts have been made to eliminate the problem described by increasing the vacuum in the suction roll and altering the tension of the fabrics. Different kinds of fabric have also been tried. Despite these attempts, the problem still persists, or at least it appears soon after changing a new fabric. In practice, increasing the level of vacuum in the suction roll has little effect, as the vacuum effect only extends to the very surface of the fabric. Thus it is nearly impossible to use a suction roll to pull an edge that has already separated back onto the surface of the fabric. The problem is exacerbated when the velocity of the web is increased.

European patent application number 1101864 discloses an arrangement in the press section of a paper machine. The core invention relates to a felt guide roll transfer in transferring the web from the press felt to the next press felt after a suction roll. In the second embodiment of the invention, a suction box is disclosed between the press nip and the suction roll, which is intended to prevent the re-wetting of the press felts, and thus the web, after the press nip.

The suction box presented is long. In that case, the production of a vacuum in the full-width suction box consumes much energy. Due to friction, the large suction box also acts as a brake on the press felt and wears it rapidly. The suction box has a low controlling effect on the web, as there is an obvious discontinuity point in the vacuum effect in the machine direction, due to the mutual positioning of the suction box and the suction roll. It is also difficult to set a large suction box in the correct position while its support requires large structures in an otherwise cramped position.

SUMMARY OF THE INVENTION

The invention provides a new type of arrangement for controlling the web in a press section of a paper or board machine, which can be easily fitted to the press section and by means of which the control of the web is better and easier than previously.

More particularly the invention includes an arrangement for controlling the web in a press section of a paper of board machine, which press section includes

- at least one press nip, which is formed of two press rolls set opposite to each other,
- two fabrics arranged to travel through the press nip, which are arranged to transport the web being manufactured on the paper or board machine,
- a suction roll arranged after the press nip, for transferring the web to the desired fabric, when the web is travelling being between the fabrics between the press nip and the suction roll, and
- suction apparatus in connection with the suction roll, in which there is a cover equipped with suction openings, and which is arranged in connection with the fabrics, and is characterized in that suction apparatus includes at least one suction case, which is arranged in a closing throat and/or an opening throat formed by one of the fabrics and the suction roll, and which is arranged before and/or after the suction roll in the edge of the fabric in order to create a suction effect in a narrow edge area of the web compared to the full width of the web.

In a specific embodiment, the suction apparatus may include two or four suction cases, which are arranged in different edge areas of the web. The suction case may include side seals extending, as a continuation of the cover, for a distance from the point of contact of the fabric and the suction roll, in order to create an essentially continuous suction effect between the suction case and the suction roll. In addition to the suction case, the side seals may also be shaped to conform to the shape of the suction roll.

The suction case may be delimited not only by end pieces, but also by a bottom piece, which is arranged at a distance from the cover, in order to create a suction case that is open on the side facing the throat. There may be a lubricant connection in connection with the first edge of the cover in the direction of travel of the fabric, in order to lead lubricant between the cover and the fabric. The suction case may include a transverse bearer fitted to the end piece, for adjusting the position of the suction case relative to the fabric and the angle of the suction case relative to the suction roll. The vacuum connection, forming part of the suction case for creating a vacuum, may be arranged to act as the bearer.

The length of the essentially continuous suction-effect area from the point of contact between the fabric and the suction roll is about 100-300 mm, preferably 150-250 mm, in the direction of travel of the web, the proportion of the cover of which length is at most half. The width of the suction-effect area created using the suction case may be 50-500 mm, preferably 150-250 mm. The arrangement may include a concave plate-like guide arranged before the suction case, and which is arranged to touch the fabric with its edge. At the first edge of the suction case in the direction of rotation of the suction roll, there may be a doctor blade for removing air and water from the surface of the suction roll. The cover of the suction case fitted in the opening throat may be convex.

The use of the arrangement according to the invention brings the web, and particularly its edges securely under control. Despite the effective operation, the vacuum capacity required is small and there is little effect on the movement and wear of the fabric. The suction case belonging to the arrangement can be easily applied in different kinds of press sections. In addition, the suction case according to the invention requires little installation space and its adjustment is versatile but easy.

These and other features and advantages of the invention will be more fully understood from the following detailed description of the invention taken together with the accompanying drawings.

DETAILED DESCRIPTION OF THE INVENTION

Figure 1:
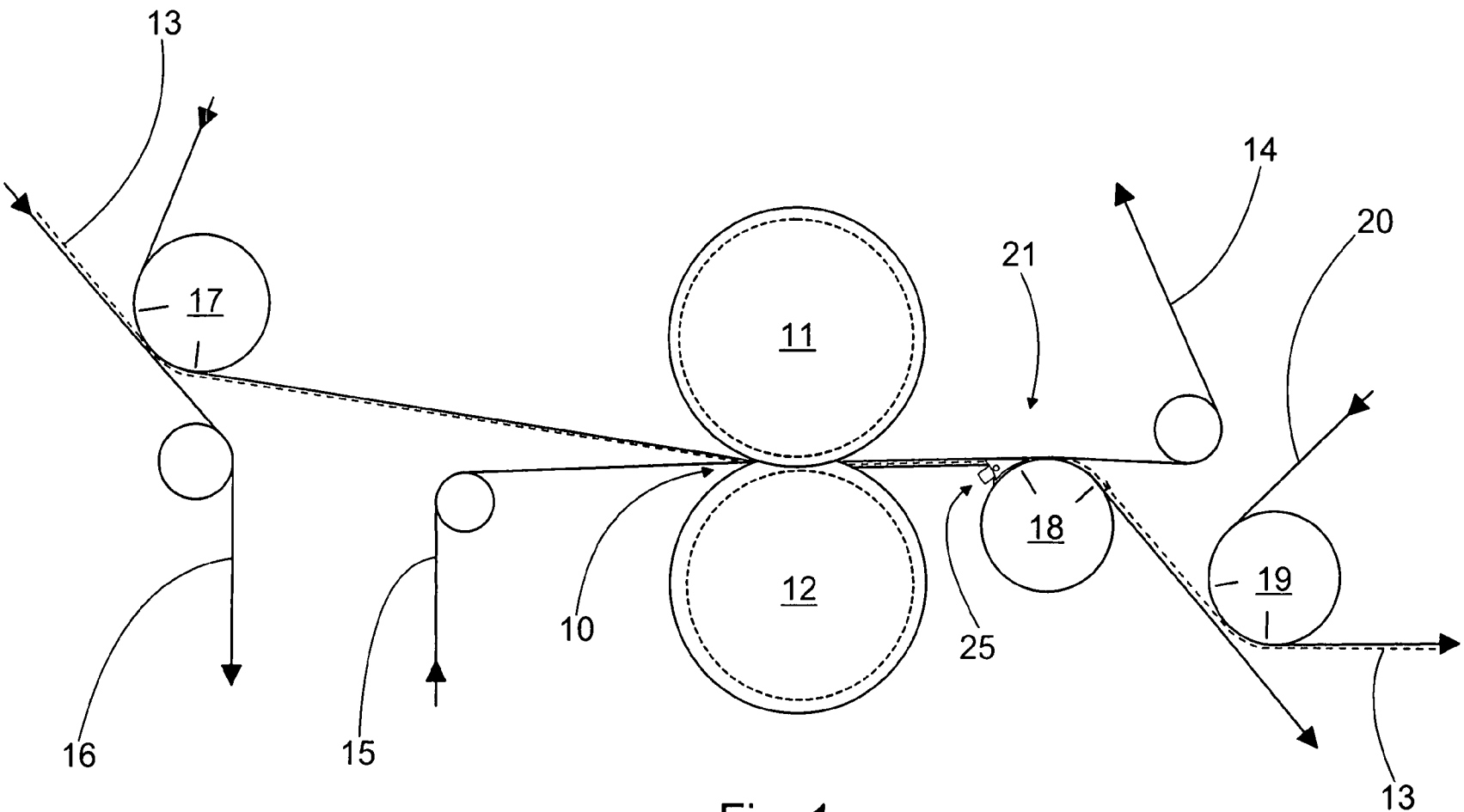
FIG. 1 shows a schematic diagram of the arrangement according to the invention in a press section.

FIG. 1 shows a schematic diagram of the arrangement according to the invention. The arrangement is intended for controlling the web in the press section of a paper or board machine, especially in the edge areas of the web. In other words, with the aid of the invention, the web is led in the desired manner through the press section, without reducing the quality or quantity of the web. FIG. 1 shows a press section that is, as such, conventional and includes a press nip 10. The press nip 10 is formed from two press rolls 11 and 12 set opposite to each other. Either of the rolls 11 and 12 can also be a long nip roll equipped with a press shoe. Usually, there is at least one press nip in the press section, though generally there are several of them, and also several fabrics too.

The web is made in the web-forming section (not shown) preceding the press section. When the web is led to the press section, it contains a great deal of water, which is removed in the press nip. The web, which has very little tensile strength, is transported with the aid of fabrics 14 and 15. In the press section, the fabrics are usually press felts, which absorb water and at least partly allow air to pass through them. Usually, there are two fabrics at a press nip, which are arranged to travel through the press nip. During the actual pressing event, the web lies between the fabrics. In FIG. 1, the web 13 is shown by a broken line. A transfer suction roll 17 is used to transfer the web 13 from the wire 16 of the web-forming section to the first press-nip fabric 14, along with which the web 13 travels to the press nip 10. The second fabric 15 of the press nip 10 comes into contact with the web 13 at the latest in the press nip 10.

The press section also includes a suction roll 18, which is arranged after the press nip 10 and with is also termed a felt suction roll. The suction roll in question is used to transfer the web to the desired fabric. When travelling between the press nip and the suction roll, the web is between the fabrics. When the fabrics again separate, the said suction roll is used to transfer the web to the desired fabric in a controlled manner. In other words, the web is forced by the suction roll to travel on the surface of a specific fabric. The drawbacks of the prior art relate precisely to the situation in which the web detaches, in which the edges of the web attempt to follow the wrong fabric. In FIG. 1, the web 13 has been transferred, after the press nip 10, to travel on the surface of the lower fabric 15, from which the web 13 is transferred, using a second transfer suction roll 19, to the next fabric 20, for example, to the felt of the next press, or to the drying wire of the dryer section. The fabrics shown are endless loops, of which only part is shown in this connection.

The arrangement also includes a suction apparatus in connection with the suction roll 18. In the suction apparatus, there is a cover equipped with suction openings, and it is arranged in connection with the fabrics. According to the invention, the suction apparatus 21 includes at least one suction case 24 or 24', which is arranged in the closing throat 25, and/or in the opening throat 25' formed by the fabric 15 and the suction roll 18. According to FIGS. 1 and 4-6, the suction cases 24 and/or 24' surprisingly extend completely to the bottom of the throats 25 or 25', which is difficult to implement over the entire width of the web, using the prior art. In addition, the suction cases are arranged at the edges of the web. Thus the suction effect before the suction roll and/or after the suction roll, and which is obtained using the suction case, is in the edge area of the web, which is relatively narrow, compared to the whole width of the web. Thus, a narrow suction case is used to bring the edge of the web securely under control and held on the surface of the desired fabric. The previous flutter and stretching of the edges are also eliminated, along with the other problems created by those phenomena.

The problems are eliminated especially by arranging one or two suction cases at both edges of the fabric. Thus, the suction apparatus preferably includes two or four suction cases, which are arranged in the various edges areas of the web. In narrow and otherwise small suction cases, a significant vacuum can be used, without greatly affecting the travel of the fabrics and without significant increases in operating costs. If necessary, suction cases are also arranged in the opening throat, in which case the suction apparatus includes four suction cases.

Figure 2:
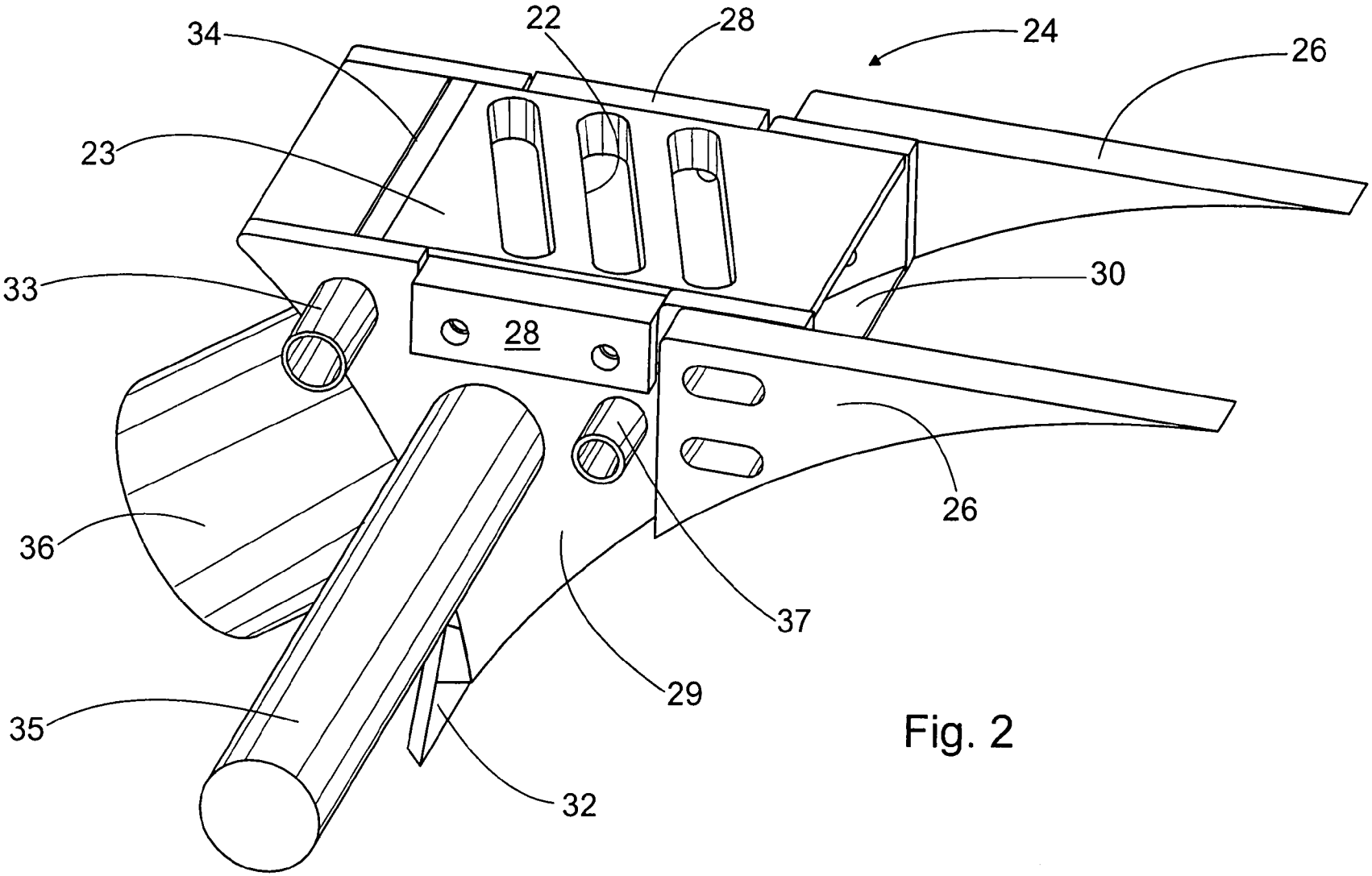
FIG. 2 shows an axonometric view of the suction case belonging to the arrangement according to the invention.
Figure 4:
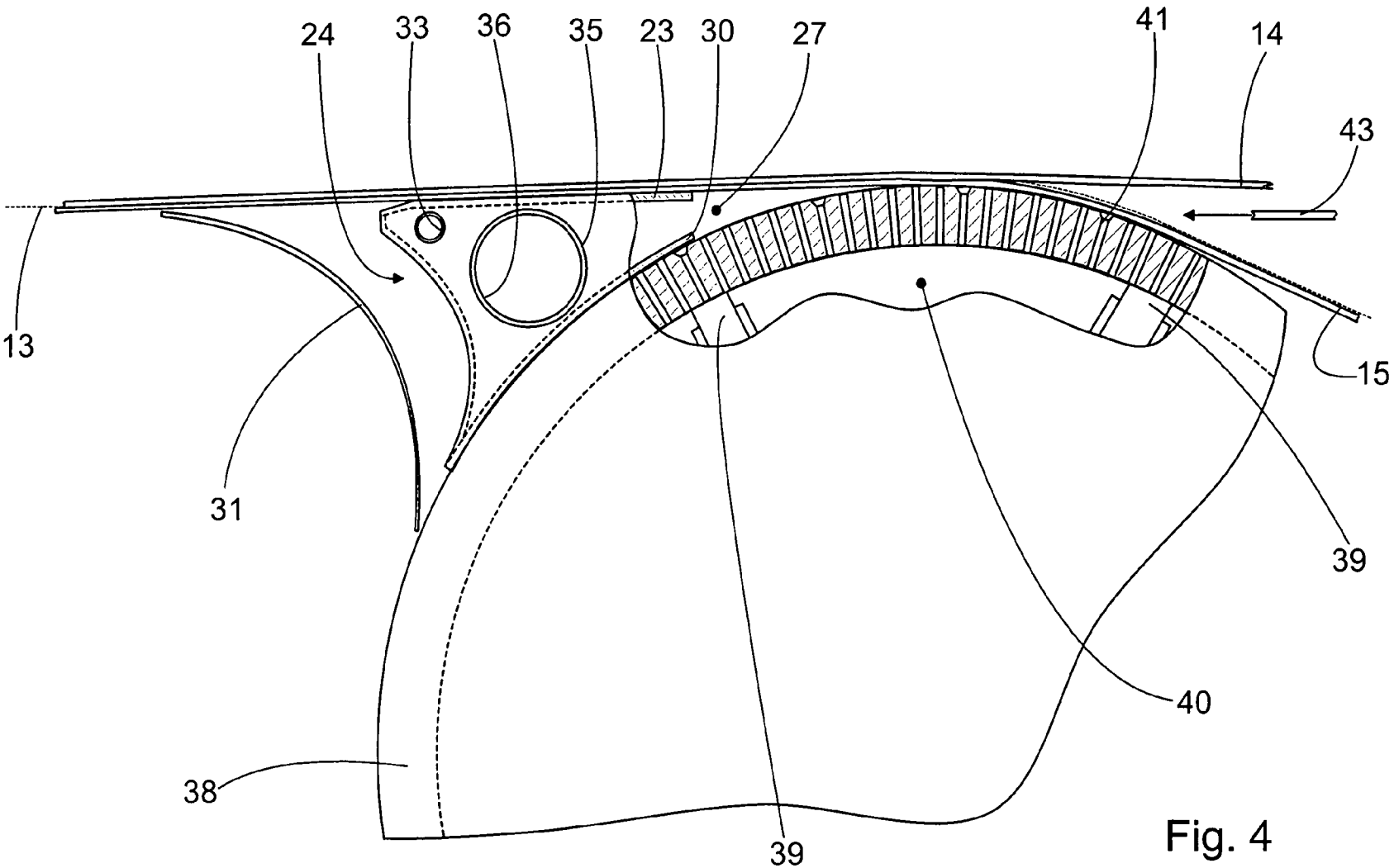
FIG. 4 shows a side view of the suction case according to the invention arranged in a throat formed between the fabric and the suction roll.

FIG. 2 shows a suction case 24 according to the invention, which is delimited on the fabric 15 side by a cover 23. According to the invention, side seals 26, which extend for a distance from the point of contact of the fabric 15 and the suction roll 18, form part of the suction case 24 as a continuation of the cover 23. In practice, the suction case and particularly the side seals are very deep in the throat. Together with the fabric 15, the suction roll 18, and the suction case 24, the side seals 26 form a space 27, in which a vacuum is formed (FIG. 4). An essentially continuous suction effect is then formed between the suction case and the suction roll. Thus, a vacuum is directed onto the fabric, and through it onto the edge of the web, for a considerable distance in the direction of travel of the web, so that the web in its entirety is held on the desired fabric. In addition, the angle and position of the side seals relative to the suction case are adjustable. The angle of the side seals can also be used to tension the web. In addition, loadable and lockable additional seals 28 can be used in the suction case, which will reduce the friction created and the wear of the fabric. The additional seals can also act as flexible elements, for example, when dirt or web accumulations in the fabric strike the suction case.

The suction case 24 is hollow and is delimited by a bottom piece 30, in addition to the end pieces 29. According to the invention, at the front edge of the suction case 24, the bottom piece 30 is arranged at a distance from the cover 23 (FIGS. 2 and 4). Thus, the vacuum spreads from the suction case 24, which is open at its front part, into the space 27 delimited by the side seals 26. On the other hand, the vacuum formed by the suction roll can also extend into the suction case. The front part of the suction case can also be only partly open. In that case, there are suitable openings in the front part for permitting the spread of the vacuum (not shown). The same reference numbers are used for components that are functionally similar.

The end and bottom pieces of the suction case are preferably triangular in shape. In addition, they have a curved shape, allowing the suction case to be placed deep in the throat. In addition to the suction case, the side seals are also shaped to conform to the suction roll. This allows the side seals to even be in contact with the surface of the suction roll. The side seals are, however, intended to be adjusted to a distance of 0.5-3 mm from the surface of the suction roll, which will avoid wear in the side seals, but achieve a sufficient seal. One side of the bottom piece is also concave, so that water and air coming with the fabric will be guided smoothly down by the suction case. In order to ensure the operation of the suction case 24, the arrangement also includes a concave plate-like guide 31 arranged before the suction case 24 (FIG. 4). The guide 31 is located next to and in front of the suction case 24 and is at least as wide as the suction case 24. The guide is used to prevent water and air from travelling into the suction case, thus stabilizing the operation of the suction case and reducing its dirtying. The guide can be attached to the suction case, or a separate support can be used. In addition, the guide is preferably arranged to touch the fabric lightly with its edge, so that the greatest possible amount of water and air is guided away from the throat. Water also travels with the suction roll 18, and can be doctored off using a doctor blade 32 (FIG. 2) arranged in the suction case 24 according to the invention. The doctor blade too is at least as wide as the suction case and is arranged at the first edge of the suction case in the direction of rotation of the suction roll. The guide and doctor blade are used particularly in the suction case placed in the closing throat.

Various guides are important in order to avoid dirtying. However, the ceramic cover continuously rubs against the fabric, with the vacuum further increasing the friction. In order to avoid damage, a lubricant connection 33 is arranged in association with the first edge of the cover 23 in the direction of travel of the fabric. Lubricant is led between the cover 23 and the fabric from the lubricant connection 33, thus reducing friction. The lubricant is preferably water. In this case, the lubricant connection 33 terminates in a gap 34 opening out to the cover 23.

Figure 3:
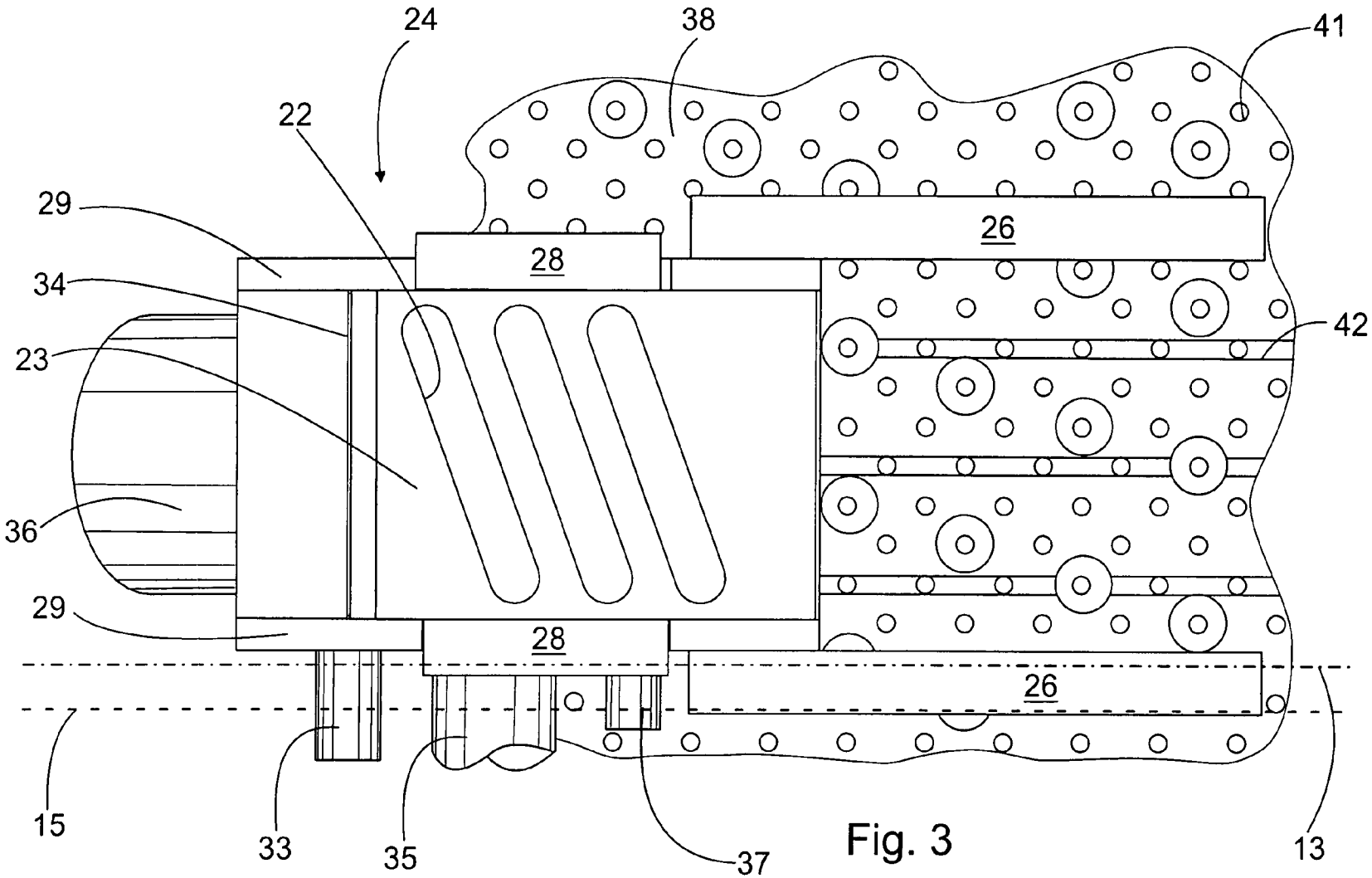
FIG. 3 shows a top view of the suction case of FIG. 2 arranged in connection with a suction roll.

The suction case according to the invention is small and light. The suction case used in tests weighed only about 40 kg, making it easy to support. According to the invention, the suction case 24, or 24' includes a transverse bearer 35 fitted to the end piece 29. Thus, both the position of the suction case relative to the fabric and the angle of the suction case relative to the suction roll can be adjusted using the same bearer. Particularly when using a cylindrical bearer 35, the suction case 24 can be rotated steplessly (FIG. 2). Though a vacuum can be created in the suction case through the suction roll, it is preferable to equip the suction case with its own vacuum connection. The vacuum in the suction case can then be easily regulated and a greater vacuum than that in the suction roll can be used. FIGS. 2 and 3 show two vacuum connections, the larger 36 of which is parallel to the suction case 24 and it is intended to attach a large-diameter hose to it. In this way, a large volume flow will be created to the vacuum connection. If there is a lack of space, or if a greater vacuum is used, there is also a second vacuum connection 37 in the end piece 29 of the suction case 24. The suction case then takes up as little space as possible in the machine direction. In FIG. 4, the vacuum connection 36 belonging to the suction case 24 is arranged to form the bearer 35, which further simplifies the construction of the suction case. In this case, the end piece has a thick pipe, which thus acts as both the bearer and the vacuum connection.

In the disclosed and other known press sections, the angle of cover of the fabric is small before the detaching of the fabric. In other words, in the prior art the area of the vacuum effect is extremely short, despite the extensive vacuum zone of the suction roll. According to the invention, the length of the continuous vacuum-effect area from the point of contact of the fabric and the suction roll is about 100-300 mm, preferably 150-250 mm, in the direction of travel of the web. This is many times more than in the prior art. The proportion of the cover of the said length is at most half, so that a significant part of the vacuum area is also formed with the aid of the space delimited by the side seals.

The suction case has also be made intentionally narrow, allowing the stretching and fraying problems of the edges of the web to be resolved precisely. In practice, fraying of the edges nearly always causes a web break. According to the invention, the width of the vacuum-effect area created by the suction case is 50-500 mm, preferably 150-250 mm. Thus, even a large vacuum can be used, as the surface area in which a vacuum is to be created is small compared, for example, to the suction roll, a full-web-width suction box. In practice, in tests the vacuum used inside the vacuum case is about 5-50 kPa, preferably about 15-30 kPa.

FIG. 3 shows the suction case 24 according to the invention fitted in connection with a suction roll 18. In this case, the suction openings 22 in the cover 23 at set an angle, which arrangement is used to tension the edge of the web. The shaping of the suction openings can also be used to affect the magnitude of the vacuum, which for its part will also tension the web. In FIG. 3, the location of the edge of the fabric 15 is shown with a broken line and the location of the edge of the web 13 is correspondingly shown with a dot-dash line.

FIG. 4 shows the suction roll 18 and the suction case 24 in partial cross-section. In the known manner, the suction roll has a perforated jacket 38, inside which there is a suction zone 40 delimited by seals 39. By using the suction case according to the invention, the suction effect area can be made advantageously long, thus eliminating the problem of the web edges detaching when a sufficient adhesion impulse towards the fabric 15 is formed in the edges of the web.

Figure 5A:
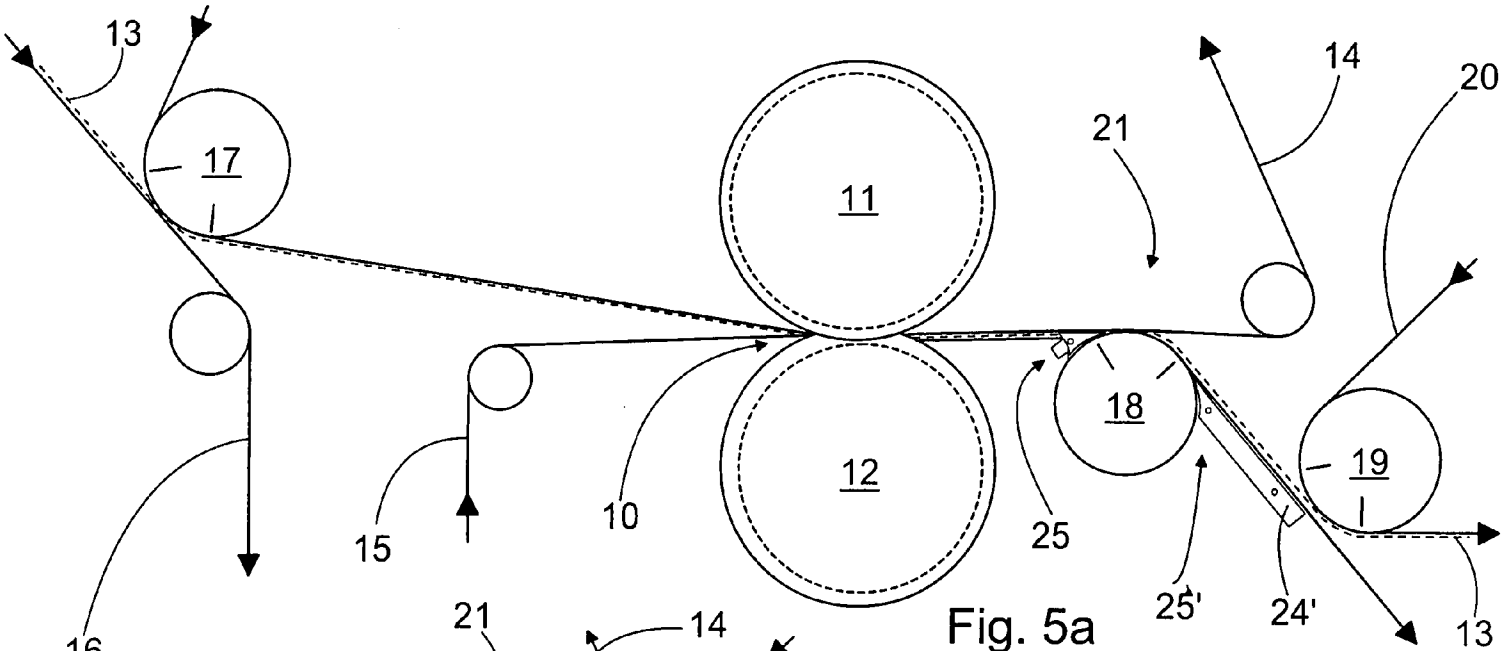
FIG. 5*a* shows a schematic diagram of a second arrangement according to the invention in a press section.
Figure 5B:
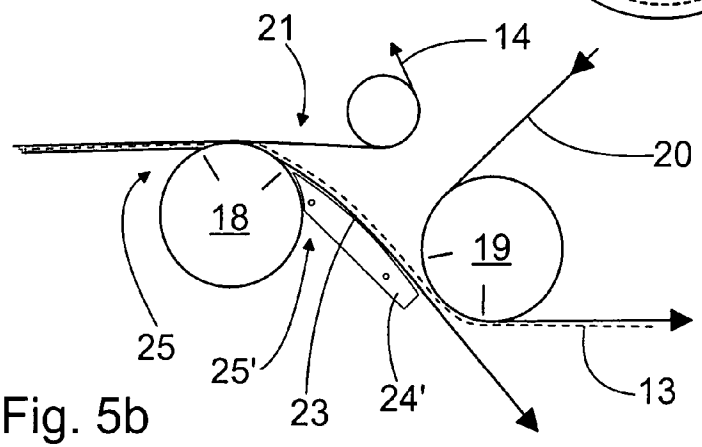
FIG. 5*b* shows a variation of the arrangement of FIG. 5*a*.
Figure 6:
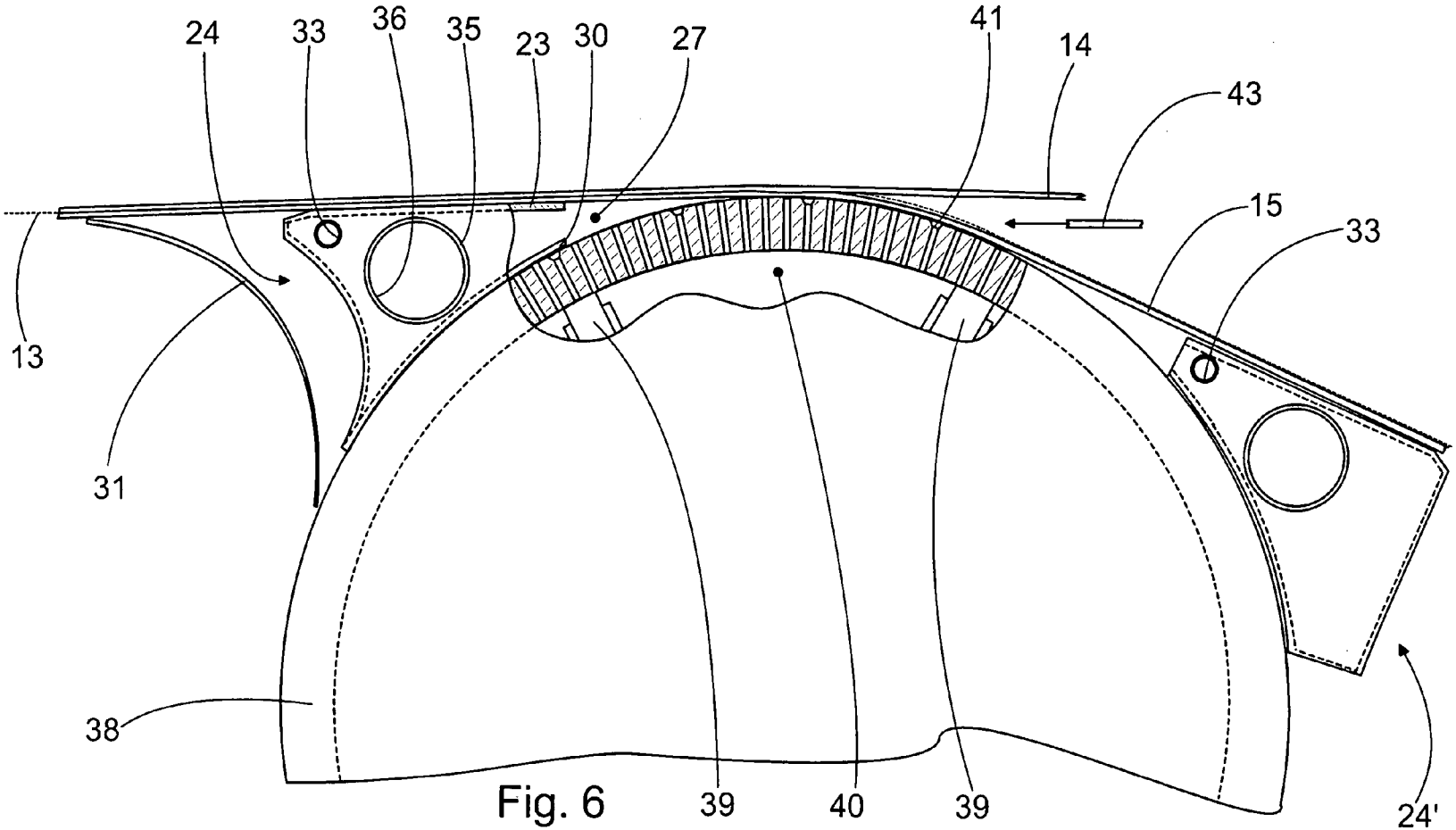
FIG. 6 shows a side view of the suction case according to the invention, fitted in throats formed between a fabric and a suction roll.

In the suction roll 18 shown, some of the holes 41 are so-called countersunk. Grooves 42 connecting the holes 41 can also be used, so that the effect of the vacuum can be increased and its area of influence extended. The operation of the suction case according to the invention can be further ensured by aligning the nozzle 43 into the throat opening out after the suction roll 18, in order to create a jet of air (FIG. 4). With the aid of the air jet, excess pressure is created in the throat, so that the tendency of the web to detach from the fabric is reduced by thus removing the vacuum created by the opening throat. Here too, the air blasts are preferably arranged only in the area of the edges of the web, so that the operating costs arising from the air blasts remain small. In addition to, or in place of the air jet, a suction case according to the invention can also be placed in the opening throat (FIGS. 5*a*, 5*b*, and 6). The edges of the web can then be kept under control also after the,suction roll.

The configuration of the suction apparatus is selected as required. A small and light suction case according to the invention can be easily and quickly installed in a desired position, even as a retrofit. The number of the suction cases is mainly affected by the dimensioning of the suction roll and the cover angle of the fabric on the suction roll. The paper grade being manufactured, for example, the solids in the web, and the running speed also affect the behaviour of the edges. Particularly in situations, in which the vacuum effect is small and the cover angle is small and the running speed is high, a suction case is preferably used on both sides of the suction roll. On the other hand, in more favourable conditions, a suction case is used on one side or other of the suction roll. In FIGS. 5*a* and 6, there are suction cases 24 and 24' in both throats 25 and 25'. In addition, in FIG. 5*a*, the latter suction case 24' is arranged to extend to the transfer suction roll 19. On the other hand, FIG. 6 shows a short suction case 24', which can be shaped more simply than the suction case 24 fitted to the closing throat. FIG. 5*b* shows another application of a long suction case 24'. In this case, the cover 23 of the suction case 24' is convex, so that the edges of the web can be tensioned.

The end and bottom pieces of the suction case are preferably made form a sheet-metal material. The cover, on the other hand, is usually ceramic. The seals used are of wear and heat-resistant plastic. This avoids unnecessary wear of the fabric and provides a good seal.

The use of the arrangement according to the invention solves an annoying problem in the press section. In addition, the purchase and operating costs of the suction case according to the invention are low. Further, the suction case is highly suitable for use in different kinds of press sections. The upper and lower fabrics referred to in the descriptions of the embodiments can change places in different kinds of press section. The essential feature is the web travelling between two fabrics, the edges of which web are made to adhere to the surface of the desired fabric using the suction case according to the invention.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. An arrangement for controlling the web in a press section of a paper of board machine, which press section includes at least one press nip, which is formed of two press rolls set opposite to each other, two fabrics arranged to travel through the press nip, which are arranged to transport the web being manufactured on the paper or board machine, a suction roll arranged after the press nip, for transferring the web to the desired fabric, when the web is travelling being between the fabrics between the press nip and the suction roll, and a suction apparatus in connection with the suction roll, which is arranged before and/or after the suction roll in connection with a closing throat and/or an opening throat formed by one of the fabrics and the suction roll, and in which there is a cover equipped with suction openings, and which is arranged in connection with the fabrics, characterized in that the suction apparatus includes at least one suction case, which is arranged in the closing throat and/or opening throat in both edges of the fabric in order to create a suction effect in a narrow area of both edges of the web compared to the full width of the web, and the suction case includes side seals extending, as a continuation of the cover, for a distance from the point of contact of the fabric and the suction roll, in order to create an essentially continuous suction effect between the suction case and the suction roll.

2. An arrangement according to claim 1, characterized in that the suction apparatus includes two or four suction cases, which are arranged in different edge areas of the web.

3. An arrangement according to claim 1, characterized in that, in addition to the suction case the side seals are also shaped to conform to the shape of the suction roll.

4. An arrangement according to claim 1, characterized in that the suction case is delimited not only by end pieces, but also by a bottom piece, which is arranged at a distance from the cover, in order to create a suction case that is open on the side facing the throat.

5. An arrangement according to claim 1, characterized in that there is a lubricant connection in connection with the first edge of the cover in the direction of travel of the fabric, in order to lead lubricant between the cover and the fabric.

6. An arrangement according to claim 4, characterized in that the suction case includes a transverse bearer fitted to the end piece, for adjusting the position of the suction case relative to the fabric and the angle of the suction case relative to the suction roll.

7. An arrangement according to claim 6, characterized in that the vacuum connection, forming part of the suction case for creating a vacuum, is arranged to act as the bearer.

8. An arrangement according to claim 1, characterized in that the length of the essentially continuous suction-effect area from the point of contact between the fabric and the suction roll is about 100-300 mm in the direction of travel of the web, the proportion of the cover of which length is at most half.

9. An arrangement according to claim 1, characterized in that the width of the suction-effect area created using the suction case is 50-500 mm.

10. An arrangement according to claim 1, characterized in that the arrangement includes a concave plate-like guide arranged before the suction case, and which is arranged to touch the fabric with its edge.

11. An arrangement according to claim 1, characterized in that, at the first edge of the suction case in the direction of rotation of the suction roll, there is a doctor blade for removing air and water from the surface of the suction roll.

12. An arrangement according to claim 1, characterized in that the cover of the suction case fitted in the opening throat is convex.

* * * * *